US011480055B2

(12) United States Patent
Farabow, III et al.

(10) Patent No.: US 11,480,055 B2
(45) Date of Patent: Oct. 25, 2022

(54) MODULAR CASING MANIFOLD FOR COOLING FLUIDS OF GAS TURBINE ENGINE

(71) Applicant: Siemens Energy Global GmbH & Co. KG, Munich (DE)

(72) Inventors: John William Farabow, III, Indian Land, SC (US); Santiago R. Salazar, Charlotte, NC (US)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 0 days.

(21) Appl. No.: 17/268,482

(22) PCT Filed: Aug. 21, 2018

(86) PCT No.: PCT/US2018/047291
§ 371 (c)(1),
(2) Date: Feb. 15, 2021

(87) PCT Pub. No.: WO2020/040747
PCT Pub. Date: Feb. 27, 2020

(65) Prior Publication Data
US 2021/0262349 A1 Aug. 26, 2021

(51) Int. Cl.
*F01D 5/08* (2006.01)
*F01D 9/06* (2006.01)

(52) U.S. Cl.
CPC ..... *F01D 5/081* (2013.01); *F01D 9/065* (2013.01); *F05D 2250/141* (2013.01); *F05D 2260/2212* (2013.01); *F05D 2260/232* (2013.01)

(58) Field of Classification Search
CPC .... F01D 5/081; F01D 9/065; F05D 2240/127; F05D 2250/141; F05D 2260/20; F05D 2260/2212; F05D 2260/232
See application file for complete search history.

(56) References Cited

U.S. PATENT DOCUMENTS 3,832,090 A * 8/1974 Matto ..... F01D 5/081 415/115
4,666,368 A * 5/1987 Hook, Jr. ..... F01D 5/082 415/115

(Continued)

FOREIGN PATENT DOCUMENTS

EP 1614862 A1 1/2006
EP 2503101 A2 9/2012

(Continued)

OTHER PUBLICATIONS

PCT International Search Report and Written Opinion of the International Searching Authority dated Apr. 26, 2019 corresponding to PCT Application No. PCT/US2018/047291 filed Aug. 21, 2018.

*Primary Examiner* — Igor Kershteyn

(57) ABSTRACT

A modular casing manifold for cooling fluids of a gas turbine engine is presented. The modular casing manifold has an annular shape including an axial inner plate, an axial outer plate, a radial forward plate and a radial aft plate. The forward plate is attached to the inner and outer plates at forward end. At least a portion of the aft plate is attachable to and removable from the inner and outer plates at aft end for enabling cooling fluid to cool turbine blades of the gas turbine engine. The modular casing manifold includes preswirler segments. At least a number of the preswirler segments are attachable to and removable from the forward plate for enabling cooling fluid to cool turbine blades of the gas turbine engine. The modular casing manifold enables alternative cooling fluids to cool turbine blades of the gas turbine engine with minimal cost and assembly flexibility.

20 Claims, 3 Drawing Sheets

(56) References Cited

U.S. PATENT DOCUMENTS

| | | | | |
|---|---|---|---|---|
| 4,730,978 | A * | 3/1988 | Baran, Jr. | F01D 5/3015 415/206 |
| 4,807,433 | A * | 2/1989 | Maclin | F01D 5/081 415/115 |
| 2011/0189000 | A1 * | 8/2011 | Vedhagiri | F01D 25/08 415/178 |

FOREIGN PATENT DOCUMENTS

| | | | |
|---|---|---|---|
| EP | 3124743 | A1 | 2/2017 |
| EP | 3159486 | A1 | 4/2017 |
| JP | 2012504724 | A | 2/2012 |
| JP | WO 2015186523 | A1 | 12/2015 |
| JP | 2017082792 | A | 5/2017 |

* cited by examiner

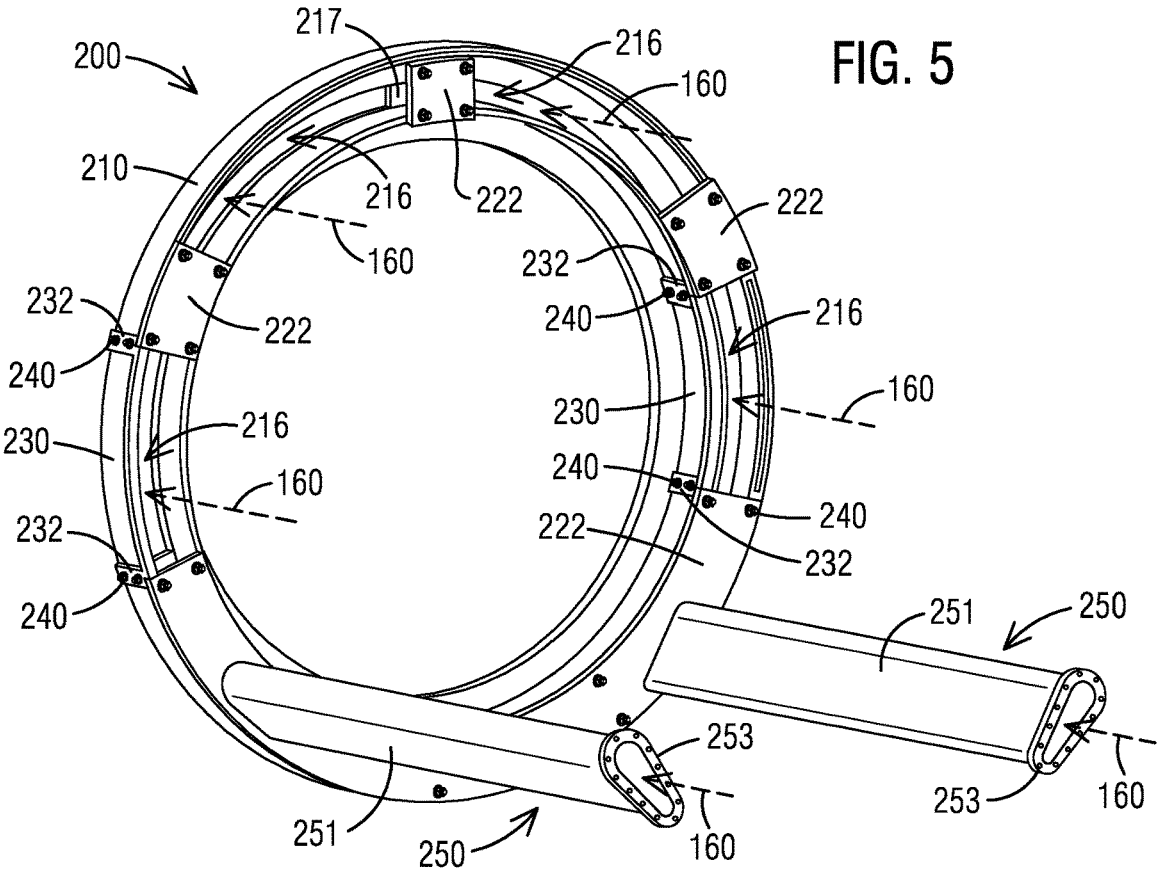
FIG. 5
FIG. 6
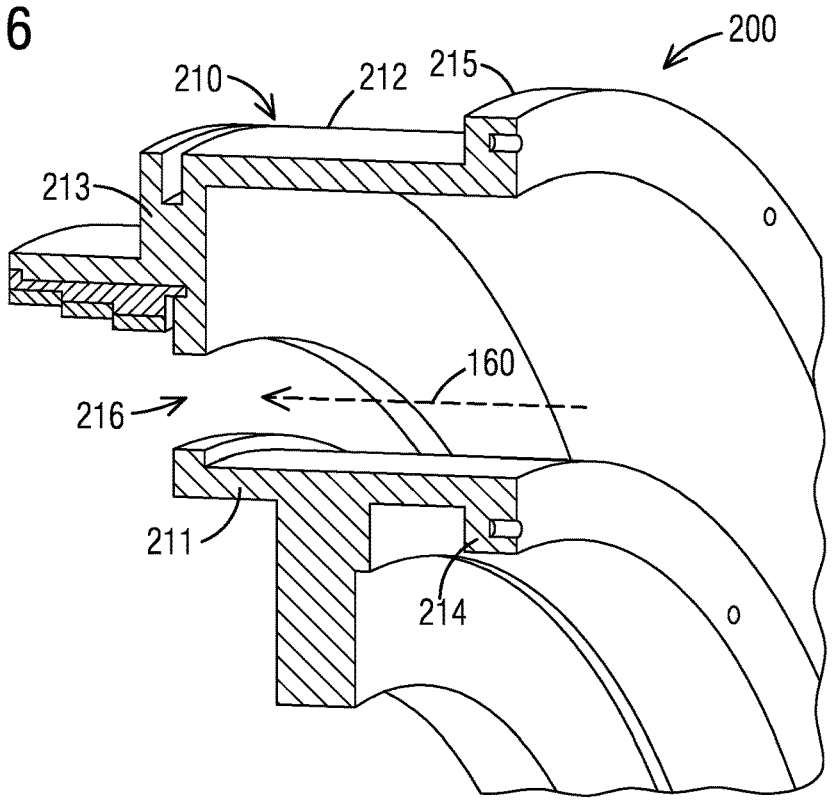

MODULAR CASING MANIFOLD FOR COOLING FLUIDS OF GAS TURBINE ENGINE

FIELD OF THE INVENTION

This invention relates generally to a modular casing manifold for cooling fluids of a gas turbine engine, in particular, a modular casing manifold that enables alternative cooling fluids, such as compressed air and ambient air, to cool turbine blades of the gas turbine engine.

DESCRIPTION OF RELATED ART

An industrial gas turbine engine typically includes a compressor for compressing air, a combustor for mixing the compressed air with fuel and igniting the mixture, a turbine section for producing mechanical power, and a generator for converting the mechanical power to an electrical power. The turbine section includes a plurality of turbine blades that are attached on a rotor disk. The turbine blades are arranged in rows axially spaced apart along the rotor disk and circumferentially attached to a periphery of the rotor disk. The turbine blades are driven by the ignited hot gas from the combustor and are cooled using a coolant, such as a cooling fluid, through cooling passages in the turbine blades.

Typically, cooling fluid may be supplied by bleeding compressor air. However, bleeding air from the compressor may reduce turbine engine efficiency. Due to high operation pressures of the first, second and third stage turbine blades, bleeding compressor air may be required for cooling the first, second and third stage turbine blades. The last stage turbine blades operate under the lowest pressure. Therefore, ambient air may be an alternative cooling fluid for cooling the last stage turbine blades.

A cooling air casing manifold is typically attached axially downstream of the last stage turbine blades. The casing manifold may include pipes for supplying compressed air from the compressor to the manifold and provide plenum to cool the last stage turbine blades. Fluid guiding system, such as preswirlers, may be attached to the casing manifold for guiding the compressed air to a swirl angle for sufficiently cooling the last stage turbine blades. However, when using ambient air to cool the last stage turbine blades, a unique swirl angle is required for achieving required boundary conditions to sufficiently cool the last stage turbine blades. Pipes are not required for bleeding the compressed air to the manifold when using ambient air to cool the last stage turbine blades. The cost for manufacturing multiple sets of casing manifold to support alternative cooling fluids for cooling the last stage turbine blades is significant. There is a need to provide a modular casing manifold that is easy to assemble and disassemble with minimal hardware cost and service time to support alternative cooling fluids for sufficiently cooling the last stage turbine blades.

SUMMARY OF THE INVENTION

Briefly described, aspects of the present invention relate to a modular casing manifold for a cooling fluid of a gas turbine engine, a gas turbine engine, and a method for cooling a gas turbine engine using a cooling fluid.

According to an aspect, a modular casing manifold of a gas turbine engine is presented. The gas turbine engine comprises a plurality of turbine blades. The modular casing manifold is arranged downstream of the turbine blades and configured to enable a cooling fluid to cool the turbine blades. The modular casing manifold comprises an inner plate having an annular shape and extending axially. The modular casing manifold comprises an outer plate having an annular shape and extending axially. The modular casing manifold comprises a forward plate having an annular shape and extending radially. The forward plate is attached to the inner plate and the outer plate at forward end. The modular casing manifold comprises an aft plate having an annular shape and extending radially. The modular casing manifold comprises a plurality of preswirler segments. At least a portion of the aft plate is configured to be attachable to and removable from the inner plate and the outer plate at aft end for enabling the cooling fluid to cool the turbine blades. At least a number of the preswirler segments are configured to be attachable to and removable from the forward plate for enabling the cooling fluid to cool the turbine blades.

According to an aspect, a gas turbine engine is presented. The gas turbine engine comprises a plurality of turbine blades. The gas turbine engine comprises a modular casing manifold arranged downstream of the turbine blades and configured to enable a cooling fluid to cool the turbine blades. The modular casing manifold comprises an inner plate having an annular shape and extending axially. The modular casing manifold comprises an outer plate having an annular shape and extending axially. The modular casing manifold comprises a forward plate having an annular shape and extending radially. The forward plate is attached to the inner plate and the outer plate at forward end. The modular casing manifold comprises an aft plate having an annular shape and extending radially. The modular casing manifold comprises a plurality of preswirler segments. At least a portion of the aft plate is configured to be attachable to and removable from the inner plate and the outer plate at aft end for enabling the cooling fluid to cool the turbine blades. At least a number of the preswirler segments are configured to be attachable to and removable from the forward plate for enabling the cooling fluid to cool the turbine blades.

According to an aspect, a method for enabling a cooling fluid to cool turbine blades of a gas turbine engine is presented. The method comprises arranging a modular casing manifold downstream of the turbine blades. The modular casing manifold comprises an inner plate having an annular shape and extending axially. The modular casing manifold comprises an outer plate having an annular shape and extending axially. The modular casing manifold comprises a forward plate having an annular shape and extending radially. The forward plate is attached to the inner plate and the outer plate at forward end. The modular casing manifold comprises an aft plate having an annular shape and extending radially. The modular casing manifold comprises a plurality of preswirler segments. At least a portion of the aft plate is configured to be attachable to and removable from the inner plate and the outer plate at aft end for enabling the cooling fluid to cool the turbine blades. At least a number of the preswirler segments are configured to be attachable to and removable from the forward plate for enabling the cooling fluid to cool the turbine blades.

Various aspects and embodiments of the application as described above and hereinafter may not only be used in the combinations explicitly described, but also in other combinations. Modifications will occur to the skilled person upon reading and understanding of the description.

BRIEF DESCRIPTION OF THE DRAWINGS

Exemplary embodiments of the application are explained in further detail with respect to the accompanying drawings. In the drawings.

FIG. 5 illustrates a schematic aft looking perspective view of a modular casing manifold configured to use ambient air to cool turbine blades of the gas turbine engine according to an embodiment of the present invention; and FIG. 6 illustrates a schematic perspective longitudinal section view of a modular casing manifold configured to use ambient air to cool turbine blades of the gas turbine engine according to an embodiment of the present invention.

To facilitate understanding, identical reference numerals have been used, where possible, to designate identical elements that are common to the figures.

DETAILED DESCRIPTION OF THE INVENTION

A detailed description related to aspects of the present invention is described hereafter with respect to the accompanying figures.

Figure 1:
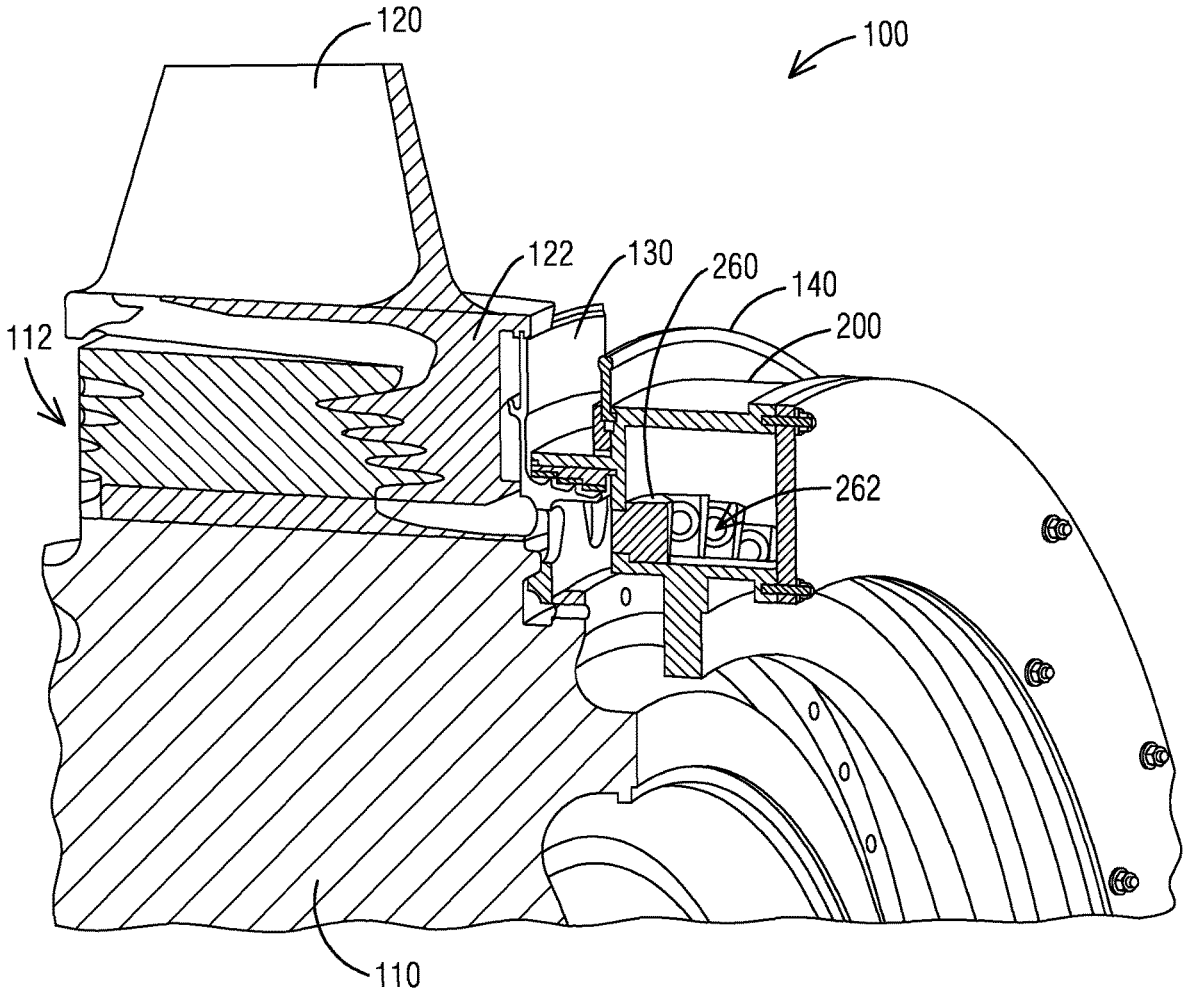
FIG. 1 illustrates a schematic perspective longitudinal section view of a portion of a gas turbine engine showing the last stage and a modular casing manifold according to an embodiment of the present invention.

FIG. 1 illustrates a schematic perspective longitudinal section view of a portion of a gas turbine engine 100 showing the last stage and a modular casing manifold 200 according to an embodiment of the present invention. As illustrated in FIG. 1, the gas turbine engine 100 includes a last stage rotor disk 110 and a plurality of last stage turbine blades 120 that are attached along an outer circumference of the rotor disk 110. Each turbine blade 120 is attached to the rotor disk 110 by inserting blade root 122 into a rotor disk groove 112. A plurality of seal plates 130 are attached to the aft side circumference of the last stage rotor disk 110. The seal plates 130 may prevent hot gas coming into the aft side of the rotor disk 110. Each seal plate 130 covers each blade root 122. For illustration purpose, only one turbine blade 120 and one seal plate 130 are shown in FIG. 1.

The gas turbine engine 100 includes a modular casing manifold 200 located downstream of the last stage turbine blades 120. The modular casing manifold 200 is arranged in an axial position after the seal plate 130. The modular casing manifold 200 has an annular shape having plenum inside. A plurality of preswirler segments 260 may be attached inside the modular casing manifold 200 circumferentially. The preswirler segment 260 have nozzles 262. The preswirler segments 260 may be removed from the modular casing manifold 200. The modular casing manifold 200 may provide a plenum for a cooling fluid entering cooling passages of the last turbine blades 120 with a swirl angle through the nozzles 262 of the preswirler segments 260 to cool the turbine blades 120. A different swirl angle may be provided to a cooling fluid by reinstalling a different geometric preswirler segments 260 or removing the preswirler segments 260. A liner seal plate 140 may be disposed circumferentially on the modular casing manifold 200 to provide a seal between the modular casing manifold 200 and turbine casing (not shown).

Figure 2:
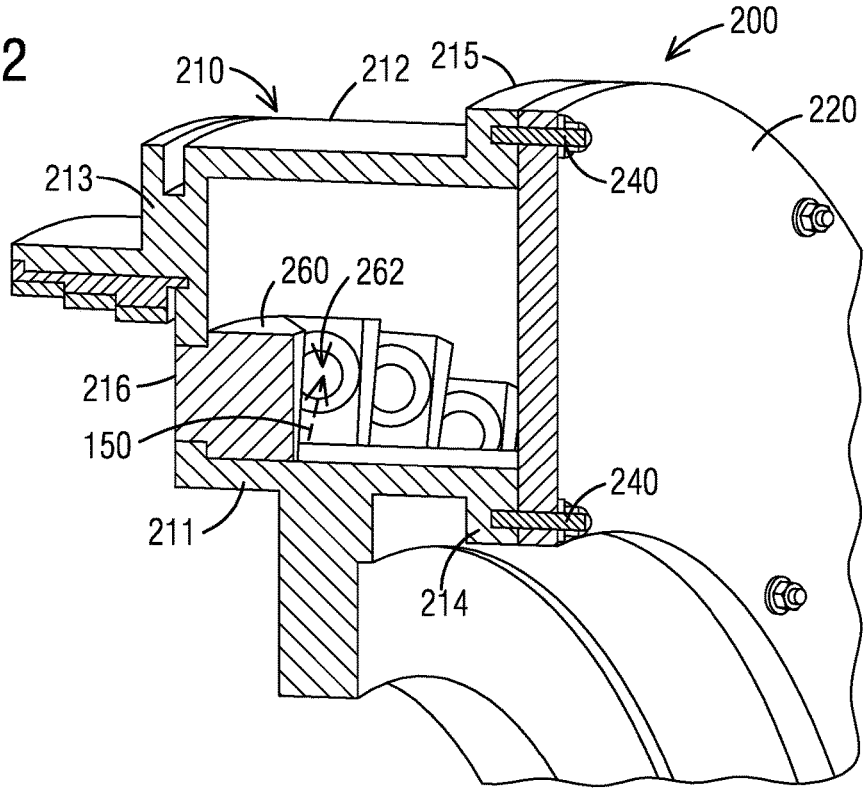
FIG. 2 illustrates a schematic perspective longitudinal section view of a modular casing manifold configured to use compressed air to cool turbine blades of the gas turbine engine according to an embodiment of the present invention.

FIG. 2 illustrates a schematic perspective longitudinal section view of a modular casing manifold 200 for compressed air 150 to cool the turbine blades 120 of the gas turbine engine 100 according to an embodiment of the present invention. As shown in FIG. 2, the modular casing manifold 200 may have an annular shape. The modular casing manifold 200 includes an inner plate 211 having an annular shape and extending axially, an outer plate 212 having an annular shape and extending axially, a forward plate 213 having an annular shape and extending radially. The forward plate 213 is attached to the inner plate 211 and the outer plate 212 at the forward end. The inner plate 211, the outer plate 212 and the forward plate 213 may be an integral piece forming a forward piece 210 having an annular U-shape with opening toward to the aft end. The modular casing manifold includes an aft plate 220 having an annular shape and extending radially. The aft plate 220 may be attached to the U-shaped annual forward piece 210 at the aft end forming the annular shaped modular casing manifold 200 having plenum inside. The aft plate 220 may be attached to the forward piece 210 by various ways. According to an exemplary embodiment as illustrated in FIG. 2, the aft plate 220 is attached to the forward piece 210 by a flange connection. As shown in FIG. 2, the inner plate 211 may have an inner flange 214 at the aft end and extending radially downward. The outer plate 212 may have an outer flange 215 at the aft end and extending radially upward. The aft plate 220 is attached to the forward piece 210 by fasteners 240 inserting into the inner flange 214 and the outer flange 215. The fasteners 240 may include screws, for example, ISO 4017 hex head screws.

With reference to FIG. 2, the forward plate 213 may have a plurality of slots 216. The slots 216 axially penetrate through the forward plate 213. The slots 216 may be located at a radial lower portion of the forward plate 213. The slots 216 are circumferentially spaced apart from each other along the forward plate 213. Each slot 216 may correspond to a preswirler segment 260. The preswirler segments 260 may be attachable to and removable from the forward plate 213 through the slots 216.

Figure 3:
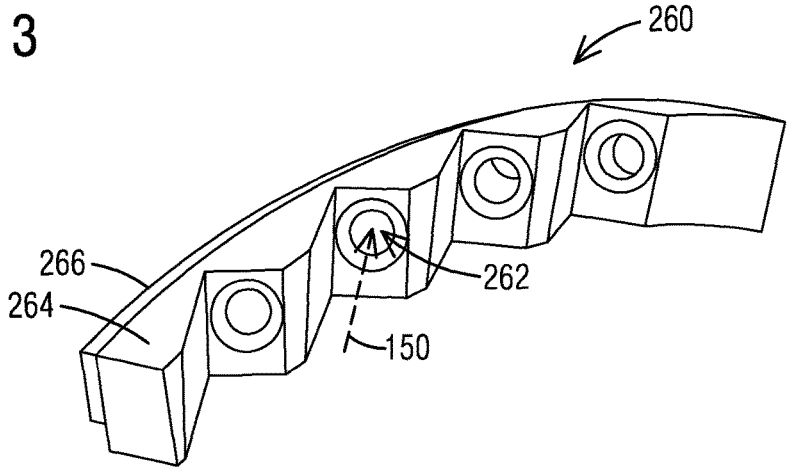
FIG. 3 illustrates a schematic perspective view of a preswirler segment according to an embodiment of the present invention.

FIG. 3 illustrates a schematic perspective view of a preswirler segment 260 according to an embodiment of the present invention. As shown in FIG. 3, the preswirler segment 260 includes a plurality of nozzles 262 arranged circumferentially and spaced apart from each other. The nozzles 262 axially penetrate through the preswirler segment 260. The nozzles 262 may be arranged in an angle with respect to an axial direction of the gas turbine engine 100 which provides a swirl angle for a cooling fluid passing through. A cooling fluid, such as compressed air 150, is guided into cooling passages of the turbine blades 120 through the nozzles 262 with the swirl angle to cool the turbine blades 120. The swirl angle may be defined based on parameters, for example, cooling fluid, cooling requirements of the gas turbine engine 100 for sufficiently cooling the turbine blades 120. A different swirl angle may be provided to a cooling fluid by reinstalling a different geometric preswirler segments 260 or removing the preswirler segments 260 to meet the cooling requirements of the gas turbine engine 100.

The preswirler segment 260 includes a main body 264 and a protrusion 266 extending axially forward from forward side of the main body 264. The protrusion 266 mates with the slot 216 of the modular casing manifold 200. The preswirler segment 260 is attachable to the modular casing manifold 200 by inserting the protrusion 266 into the slot 216 of the forward plate 213. The preswirler segment 260 is removable from the modular casing manifold 200 by removing the protrusion 266 from the slot 216 of the forward plate 213. A circumferential dimension of the protrusion 266 may be less than a circumferential dimension of the main body 264. The slots 216 on the forward plate 213 are thus circumferentially spaced apart from each other along the forward plate 213 for circumferentially attaching the preswirler segments 260 along the forward plate 213. A radial dimension of the protrusion 266 may be less than a radial dimension of the main body 264.

Figure 4:
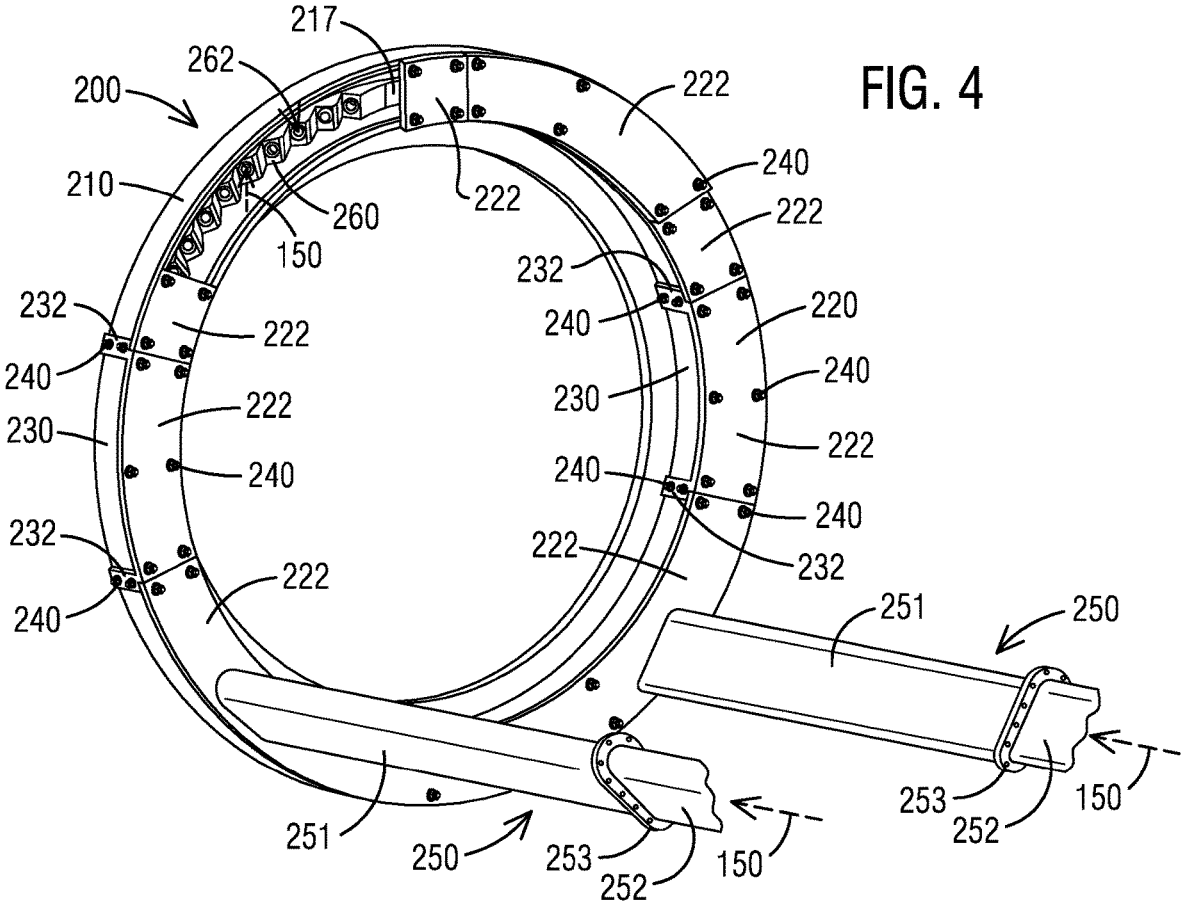
FIG. 4 illustrates a schematic aft looking perspective view of a modular casing manifold configured to use compressed air to cool turbine blades of the gas turbine engine according to an embodiment of the present invention.

FIG. 4 illustrates a schematic aft looking perspective view of a modular casing manifold 200 for compressed air 150 to cool the turbine blades 120 of the gas turbine engine 100 according to an embodiment of the present invention. According to an exemplary embodiment as shown in FIG. 4, the aft plate 220 may include a plurality of aft plate segments 222, The aft plate segments 222 are circumferentially attached to the forward piece 210. The aft plate segments 222 may be attached to the forward piece 210 by fasteners 240. For clarification purpose, one aft plate segment 222 is removed from the modular casing manifold 200. It is understood that the aft plate 220 may be a single circumferential plate. The preswirler segments 260 are circumferentially attached to the modular casing manifold 200 via the slots 216 of the forward plate 213. The slots 216 axially penetrate through the forward plate 213. The slots 216 are circumferentially spaced apart from each other along the forward plate 213. The forward plate 213 includes panels 217 that are circumferentially arranged between the slots 213 for supporting the forward plate 213.

The modular casing manifold 200 may include a pipe 250. One end of the pipe 250 is attached to the aft plate 220 of the modular casing manifold 200. According to an exemplary embodiment as shown in FIG. 4, the pipe 250 is attached to an aft plate segment 222. The other end of the pipe 250 may be connected to a compressor (not shown) of the gas turbine engine 100 to bleed the compressed air 150 to the modular casing manifold 200. The pipe 250 may include a first pipe segment 251 with the one end connected to the modular casing manifold 200 and a second pipe segment 252 with the other end connected to the compressor of the gas turbine engine 100. The first pipe segment 251 and the second pipe segment 252 may be connected to each other by a flange 253. The compressed air 150 is bled from the compressor through the second pipe segment 252 and flows into the modular casing manifold 200 through the first pipe segment 251. The compressed air 150 then enters cooling passages of the turbine blades 120 with a swirl angle through the nozzles 262 of the preswirler segments 260 for cooling the turbine blades 120 of the gas turbine engine 100. For illustration purpose, two pipes 250 are shown in FIG. 4 that are connected to the modular casing manifold 200. It is understood that other numbers of pipes 250 may be connected to the modular casing manifold 200 according to design criteria of the gas turbine engine 100.

The modular casing manifold 200 may include blade access panel 230. The blade access panel 230 may be attached to the forward piece 210. The blade access panel 230 may include flanges 232 disposed at two circumferential ends. The blade access panel 230 may be attached to the forward piece 210 by fasteners 240 inserting into the flanges 232 at the two circumferential ends. The blade access panel 230 is removable from the modular casing manifold 200 for accessing the turbine blades 120. For illustration purpose, two blade access panels 230 are shown in FIG. 4 on each side of the modular casing manifold 200. It is understood that the modular casing manifold 200 may have other numbers of blade access panels 230.

During operation of the gas turbine engine 100, a different geometric preswirler segments 260 having a different swirl angle may be needed for sufficiently cooling the turbine blades 120 using the compressed air 150 to meet a different cooling requirement of the gas turbine engine 100. According to an embodiment, the preswirler segments 260 may be removed from the slots 216 of the modular casing manifold 200 through the blade access panels 230. Different geometric preswirler segments 260 may be reinstalled into the slots 216 of the modular casing manifold 200 through the blade access panels 230. The blade access panel 230 is disassembled from the modular casing manifold 200 for removing the preswirler segments 260 and for reinstalling the different geometric preswirler segments 260. The blade access panel 230 is assembled back to the modular casing manifold 200 after reinstallation of the different geometric preswirler segments 260.

When operating the gas turbine engine 100, bleeding the compressed air 150 from a compressor may reduce an efficiency of the gas turbine engine 100. The last stage turbine blades 120 may be cooled using the compressed air 150 or ambient air due to the lowest operating pressure. When using ambient air to cool the last stage turbine blades 120, the second pipe segment 252 connected to the compressor of the gas turbine engine 100 for bleeding the compressed air 150 is not required. The second pipe segment 252 may be removed from the modular casing manifold 200 at the flange 253. At least a portion of the aft plate 220 needs to be removed from the modular casing manifold 200 to form an opening such that the ambient air may flow into the modular casing manifold 200 and enter cooling passages of the turbine blades 120. Different swirl angles may be required when using the ambient air to cool the turbine blades 120 than using the compressed air 150. According to an embodiment, different geometric preswirler segments 260 may be installed for the ambient air to cool the turbine blades 120. According to another embodiment, at least a number of the preswirler segments 260 may be removed from the modular casing manifold 200 for the ambient air to cool the turbine blades 120.

FIG. 5 illustrates a schematic aft looking perspective view of a modular casing manifold 200 for ambient air 160 to cool the turbine blades 120 of the gas turbine engine 100 according to an embodiment of the present invention. As shown in FIG. 5, at least a portion of the aft plate 220 may be removed from the modular casing manifold 200. According to an exemplary embodiment as shown in FIG. 5, a number of the aft plate segments 222 are removed from the modular casing manifold 200. At least a number of the preswirler segments 260 may be removed from the slots 216 axially penetrating through the forward plate 213 of the forward piece 210 of the modular casing manifold 200. The forward plate 213 includes panels 217 that are circumferentially arranged between the slots 216 for supporting the forward plate 213. The ambient air 160 may flow into the modular casing manifold 200 through openings formed by removal of the aft plate segments 222. The ambient air 160 may enter cooling passages of the blades 120 through the slots 216 after removal of the preswirler segments 260.

The number of the aft plate segments 222 to be removed depends on a cooling requirement of the turbine blades 120. The higher of the cooling requirement, the greater number of the aft plate segments 222 to be removed. The entire number of the aft plate segments 222 may be removed from the modular casing manifold 200 to meet the cooling requirement. The aft plate 220 may be a single plate and removed entirely. A portion of the aft plate 220 may be remained to the modular casing manifold 200. According to the exemplary embodiment as shown in FIG. 5, the aft plate segment 222 having the first pipe segment 251 may be remained to the modular casing manifold 200 for assembly and disassembly considerations. The ambient air 160 may also flow into the modular casing manifold 200 through the first pipe segment 251 connected to the remained aft plate segment 222. Some of the aft plate segments 222 may be remained for mechanical strength consideration. According to the exemplary embodiment as shown in FIG. 5, all aft plate segments 222 are attached to the modular casing manifold 200 by fasteners 240. It is understood that the remained aft plate segments 222 may be attached to the modular casing manifold 200 by fixed connections, such as by welding.

The number of the preswirler segments 260 to be removed depends on a cooling requirement of the turbine blades 120. The higher of the cooling requirement, the greater number of the preswirler segments 260 to be removed. The entire number of the preswirler segments 260 may be removed from the modular casing manifold 200 to meet the cooling requirement. The preswirler segments 260 may be removed from the slots 216 of the forward plate 213 of the modular casing manifold 200 after removal of the aft plate segments 222. The preswirler segments 260 may be removed from the slots 216 of the forward plate 213 of the modular casing manifold 200 through the blade access panel 230. The preswirler segments 260 that are behind the remained aft plate segments 222 may be removed through the blade access panel 230. The blade access panel 230 is disassembled from the modular casing manifold 200 for removing the preswirler segments 260. The blade access panel 230 is assembled back to the modular casing manifold 200 after removal of the preswirler segments 260. According to another embodiment, different geometric preswirler segments 260 may be reinstalled into the slots 216 of the forward plate 213 of the modular casing manifold 200 to meet a cooling requirement of the turbine blades 120 using the ambient air 160.

FIG. 6 illustrates a schematic perspective longitudinal section view of a modular casing manifold 200 for ambient air 160 to cool the turbine blades 120 of the gas turbine engine 100 according to an embodiment of the present invention. As shown in FIG. 6, at least a portion of the aft plate 220 is removed from the inner flange 214 and the outer flange 215 at the aft end of the modular casing manifold 200. The removal of the portion of the aft plate 220 forms an opening for the ambient air 160 to flow into the modular casing manifold 200. At least a number of the presirwler segments 260 are removed from the slots 216 of the forward plate 213 which allows the ambient air 160 entering cooling passages of the turbine blades 120 arranged upstream of the modular casing manifold 200. The slots 216 are circumferentially spaced apart from each. The forward plate 213 includes panels 217 that are circumferentially arranged between the slots 216 for supporting the forward plate 213, as shown in FIG. 5. The ambient air 160 flows into the modular casing manifold 200 from the opening formed by removal of the portion of the aft plate 220. The ambient air 160 then enters cooling passages of the turbine blades 120 through the slot 216 after removal of the at least number of the preswirler segments 260 for cooling the turbine blades 120.

According to an aspect, the proposed modular casing manifold 200 may enable alternative cooling fluids, such as compressed air 150 and ambient air 160, to cool turbine blades 120 of a gas turbine engine 100. The aft plate 220, the preswirler segments 260 and the pipe 250 for bleeding the compressed air 150 are attachable to the modular casing manifold 200 when using the compressed air 150 to cool the turbine blades 120 of the gas turbine engine 100. At least a portion of the aft plate 220, a number of the preswirler segments 260 and the pipe 250 for bleeding the compressed air 150 are removable from the modular casing manifold 200 when using the ambient air 160 to cool the turbine blades 120 of the gas turbine engine 100.

According to an aspect, the proposed modular casing manifold 200 may optimize cooling fluid flow by removing the preswirler segments 260 for sufficiently cooling turbine blades 120 of a gas turbine engine 100. The proposed modular casing manifold 200 may optimize cooling fluid flow by reinstalling different geometric preswirler segments 260 for sufficiently cooling the turbine blades 120 of the gas turbine engine 100. The proposed modular casing manifold 200 may improve efficiency of the gas turbine engine 100.

According to an aspect, the proposed modular casing manifold 200 are easy to assemble and disassemble for using alternative cooling fluids, such as compressed air 150 and ambient air 160, to cool turbine blades 120 of a gas turbine engine 100 with minimal cost and assembly flexibility. The proposed modular casing manifold 200 significantly reduces manufacturing cost and service time of the gas turbine engine 100.

Although various embodiments that incorporate the teachings of the present invention have been shown and described in detail herein, those skilled in the art can readily devise many other varied embodiments that still incorporate these teachings. The invention is not limited in its application to the exemplary embodiment details of construction and the arrangement of components set forth in the description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass direct and indirect mountings, connections, supports, and couplings. Further, "connected" and "coupled" are not restricted to physical or mechanical connections or couplings.

REFERENCE LIST

100: Gas Turbine Engine
110: Rotor Disk
112: Disk Groove
120: Turbine Blade
122: Blade Root
130: Seal Plate
140: Liner Seal Plate
150: Compressed Air
160: Ambient Air
200: Modular Casing Manifold
210: Forward Piece
211: Inner Plate
212: Outer Plate

213: Forward Plate
214: Inner Flange
215: Outer Flange
216: Slot
217: Panel of Forward Plate
220: Aft Plate
222: Aft Plate Segment
230: Blade Access Panel
232: Blade Access Panel Flange
240: Fastener
250: Pipe
251: First Pipe Segment
252: Second Pipe Segment
253: Pipe Flange
260: Preswirler Segment
262: Nozzle of Preswirler Segment
264: Main Body of Preswirler Segment
266: Protrusion of Preswirler Segment

What is claimed is:

1. A modular casing manifold of a gas turbine engine, wherein the gas turbine engine comprises a plurality of turbine blades, wherein the modular casing manifold is arranged downstream of the turbine blades and configured to enable a cooling fluid to cool the turbine blades, the modular casing manifold comprising:

an inner plate having an annular shape and extending axially;

an outer plate having an annular shape and extending axially;

a forward plate having an annular shape and extending radially, wherein the forward plate is attached to the inner plate and the outer plate at forward end;

an aft plate having an annular shape and extending radially;

a plurality of preswirler segments;

wherein at least a portion of the aft plate is configured to be attachable to and removable from the inner plate and the outer plate at aft end for enabling the cooling fluid to cool the turbine blades, and wherein at least a number of the preswirler segments are configured to be attachable to and removable from the forward plate for enabling the cooling fluid to cool the turbine blades.

2. The modular casing manifold as claimed in claim 1, wherein the inner plate comprises an inner flange at the aft end and extending radially downward, and wherein the aft plate is attachable to the inner plate by fasteners inserting into the inner flange.

3. The modular casing manifold as claimed in claim 1, wherein the outer plate comprises an outer flange at the aft end and extending radially upward, and wherein the aft plate is attachable to the outer plate by fasteners inserting into the outer flange.

4. The modular casing manifold as claimed in claim 1, wherein the forward plate comprises a plurality of slots axially penetrating through the forward plate.

5. The modular casing manifold as claimed in claim 4, wherein the forward plate comprises panels circumferentially arranged between the slots.

6. The modular casing manifold as claimed in claim 4, wherein each preswirler segment comprises a main body and a protrusion extending axially forward from forward side of the main body, and wherein the protrusion is configured to mate with a corresponding slot of the forward plate such that the preswirler segment is attachable to and removable from the forward plate through the slot.

7. The modular casing manifold as claimed in claim 6, wherein a circumferential dimension of the protrusion is less than a circumferential dimension of the main body.

8. The modular casing manifold as claimed in claim 6, wherein a radial dimension of the protrusion is less than a radial dimension of the main body.

9. The modular casing manifold as claimed in claim 1, wherein the aft plate comprises a plurality of aft plate segments.

10. The modular casing manifold as claimed in claim 1, further comprising a first pipe segment attached to the aft plate, wherein the first pipe segment comprises a flange, and wherein a second pipe segment is attachable to and removable from the first pipe segment through the flange for the cooling fluid.

11. A gas turbine engine comprising:

a plurality of turbine blades; and a modular casing manifold arranged downstream of the turbine blades and configured to enable a cooling fluid to cool the turbine blades, wherein the modular casing manifold comprises:

an inner plate having an annular shape and extending axially;

an outer plate having an annular shape and extending axially;

a forward plate having an annular shape and extending radially, wherein the forward plate is attached to the inner plate and the outer plate at forward end;

an aft plate having an annular shape and extending radially;

a plurality of preswirler segments, wherein at least a portion of the aft plate is configured to be attachable to and removable from the inner plate and the outer plate at aft end for enabling the cooling fluid to cool the turbine blades, and wherein at least a number of the preswirler segments are configured to be attachable to and removable from the forward plate for enabling the cooling fluid to cool the turbine blades.

12. The gas turbine engine as claimed in claim 11, wherein the inner plate comprises an inner flange at the aft end and extending radially downward, and wherein the aft plate is attachable to the inner plate by fasteners inserting into the inner flange.

13. The gas turbine engine as claimed in claim 11, wherein the outer plate comprises an outer flange at the aft and end extending radially upward, and wherein the aft plate is attachable to the outer plate by fasteners inserting into the outer flange.

14. The gas turbine engine as claimed in claim 11, wherein the forward plate comprises a plurality of slots axially penetrating through the forward plate.

15. The gas turbine engine as claimed in claim 14, wherein the forward plate comprises panels circumferentially arranged between the slots.

16. The gas turbine engine as claimed in claim 14, wherein each preswirler segment comprises a main body and a protrusion extending axially forward from forward side of the main body, and wherein the protrusion is configured to mate with a corresponding slot of the forward plate such that the preswirler segment is attachable to and removable from the forward plate through the slot.

17. The gas turbine engine as claimed in claim 16, wherein a circumferential dimension of the protrusion is less than a circumferential dimension of the main body.

18. The gas turbine engine as claimed in claim 16, wherein a radial dimension of the protrusion is less than a radial dimension of the main body.

19. The gas turbine engine as claimed in claim 11, wherein the aft plate comprises a plurality of aft plate segments.

20. A method for enabling a cooling fluid to cool turbine blades of a gas turbine comprising:

arranging a modular casing manifold downstream of the turbine blades, wherein the modular casing manifold comprises:

an inner plate having an annular shape and extending axially;

an outer plate having an annular shape and extending axially;

a forward plate having an annular shape and extending radially, wherein the forward plate is attached to the inner plate and the outer plate at forward end;

an aft plate having an annular shape and extending radially;

a plurality of preswirler segments, wherein at least a portion of the aft plate is configured to be attachable to and removable from the inner plate and the outer plate at aft end for enabling the cooling fluid to cool the turbine blades, and wherein at least a number of the preswirler segments are configured to be attachable to and removable from the forward plate for enabling the cooling fluid to cool the turbine blades.

* * * * *